US006568381B2

(12) United States Patent
Chang

(10) Patent No.: US 6,568,381 B2
(45) Date of Patent: May 27, 2003

(54) TRIGGERING MECHANISM FOR PAINT BALL GUNS

(76) Inventor: Yung Che Chang, PO Box 82-144, Taipei (TW)

( * ) Notice: Subject to any disclaimer, the term of this patent is extended or adjusted under 35 U.S.C. 154(b) by 0 days.

(21) Appl. No.: 09/969,759

(22) Filed: Oct. 4, 2001

(65) Prior Publication Data

US 2003/0066520 A1 Apr. 10, 2003

(51) Int. Cl.[7] ..... F41B 11/14
(52) U.S. Cl. ..... 124/32; 124/66
(58) Field of Search ..... 124/32, 66, 67

(56) References Cited

U.S. PATENT DOCUMENTS 2,037,129 A * 4/1936 Hilts
2,568,432 A * 9/1951 Cook
3,899,845 A * 8/1975 Wild et al.
4,848,307 A * 7/1989 Tsao ..... 124/66 X
5,186,156 A * 2/1993 Clayton ..... 124/66 X
5,261,384 A * 11/1993 Hu ..... 124/66
6,302,092 B1 * 10/2001 Juan ..... 124/32 X

* cited by examiner

*Primary Examiner*—John A. Ricci
(74) *Attorney, Agent, or Firm*—Leong C. Lei

(57) ABSTRACT

A paint ball gun includes a body portion, a handle, and a triggering mechanism mounted within the body portion and the handle, improvement wherein the triggering mechanism comprises a trigger pivotally mounted in the body portion, a micro-switch mounted within the handle and having a contact button disposed behind the trigger, a solenoid valve having a valve rod, means for controlling the valve rod of the solenoid valve by way of the micro-switch, a magnet mounted within the handle for attracting the valve rod to original position, a lever having a lower portion aligned with the valve rod and an upper end extending into a passage of the body portion, a first spring urging the upper end of the lever into the passage, a striking rod slidably fitted in the passage and having a bottom formed with a recess, and a second spring fitted in the passage and having an end urging against an end of the striking rod.

1 Claim, 4 Drawing Sheets

TRIGGERING MECHANISM FOR PAINT BALL GUNS

BACKGROUND OF THE INVENTION

1. Field of the Invention

This invention is related to an improvement in the structure of a triggering mechanism for paint ball guns and in particular to one which can be easily operated to control the fire of a paint ball gun.

2. Description of the Prior Art

As shown in FIGS. 1 and 2, the conventional triggering mechanism for a paint ball gun generally includes a striking rod 1, a first spring 12, a pawl 2, a trigger 23, and a second spring 20. The second spring 20 normally pulls the pawl 2 to rotate its upper end into the passage 12. Before a bullet can be fired from the paint ball gun, it is necessary to push the striking rod 1 backward to compress the first spring 12 so that the striking rod 1 depresses the upper end of the pawl 2 until the recess 10 formed at the bottom of the striking rod 1 receives the upper end of the pawl 2 thereby keeping the striking rod 1 in place. The pawl 2 has an elliptical through hole 21 receiving a pivot 22 so that the pawl 2 can be slightly moved forward. Referring to FIG. 1, the second spring 20 pulls the pawl 2 to go backward thereby causing the front side of the hole 21 to contact the pivot 22. However, as the first spring 11 is much stronger than the second spring 20, so that when the upper end of the pawl 2 is engaged with the recess 10 of the striking rod 1, the spring 11 will push the striking rod 1 which will in turn push the pawl 2 to go forward and the pivot 21 will be in contact with the rear side of the hole 21 thus preventing the pawl 2 to go further. In the meantime, the front end of the pawl 2 is positioned above the protuberance 230 at the rear side of the trigger 23 (see FIG. 2). When desired to fire the bullet from the paint ball gun, it is necessary to depress the trigger 23, causing the protuberance 230 to lift the front end of the pawl 2 thereby releasing the rear end of the pawl 2 from the recess 10 of the striking rod 1. Then, the first spring 12 forces the striking rod 1 to move forward to fire a bullet out of the paint ball gun. Nevertheless, as described above, the user must use his or her finger power to press the trigger 23 to release the pawl 2 from the recess 10 of the striking rod 1 in order to fire the bullet out of the gun. As we know, the second spring 2 must be very strong for a paint ball gun with long range, and so it is necessary apply a relatively large finger power to operate the trigger 23 thus often causing vibration to the gun and making it difficult to aim and decreasing the fun in playing the gun.

Therefore, it is an object of the present invention to provide an improvement in the structure of a triggering mechanism for paint ball guns, which can obviate and mitigate the above-mentioned drawbacks.

SUMMARY OF THE INVENTION

This invention is related to an improvement in the structure of a triggering mechanism for paint ball guns.

It is the primary object of the present invention to provide a triggering mechanism for paint ball guns, which utilizes a solenoid valve assembly to facilitate the triggering operation of a paint ball gun.

It is another object of the present invention to provide a triggering mechanism for paint ball guns, which uses a magnet to help the valve rod to move back its original position after each operation.

According to a preferred embodiment of the present invention, a paint ball gun includes a body portion, a handle, and a triggering mechanism mounted within the body portion and the handle, improvement wherein the triggering mechanism comprises a trigger pivotally mounted in the body portion, a micro-switch mounted within the handle and having a contact button disposed behind the trigger, a solenoid valve having a valve rod, means for controlling the valve rod of the solenoid valve by way of the micro-switch, a magnet mounted within the handle for attracting the valve rod to original position, a lever having a lower portion aligned with the valve rod and an upper end extending into a passage of the body portion, a first spring urging the upper end of the lever into the passage, a striking rod slidably fitted in the passage and having a bottom formed with a recess, and a second spring fitted in the passage and having an end urging against an end of the striking rod.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
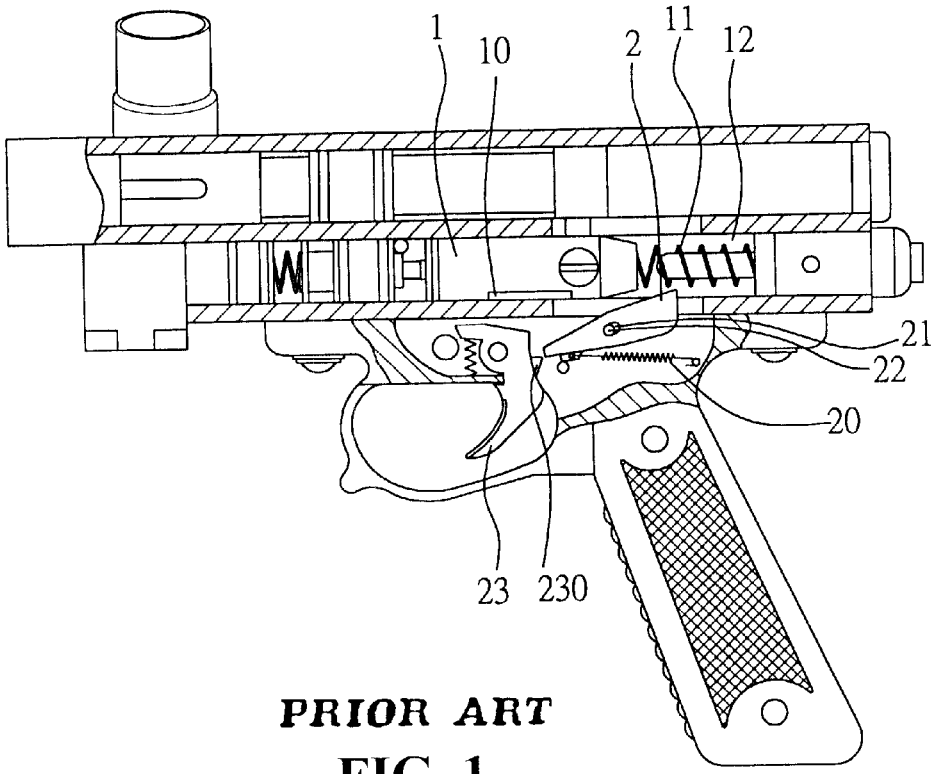
PRIOR ART FIG. 1
FIG. 1 is a sectional view of a prior art paint ball gun.
Figure 2:
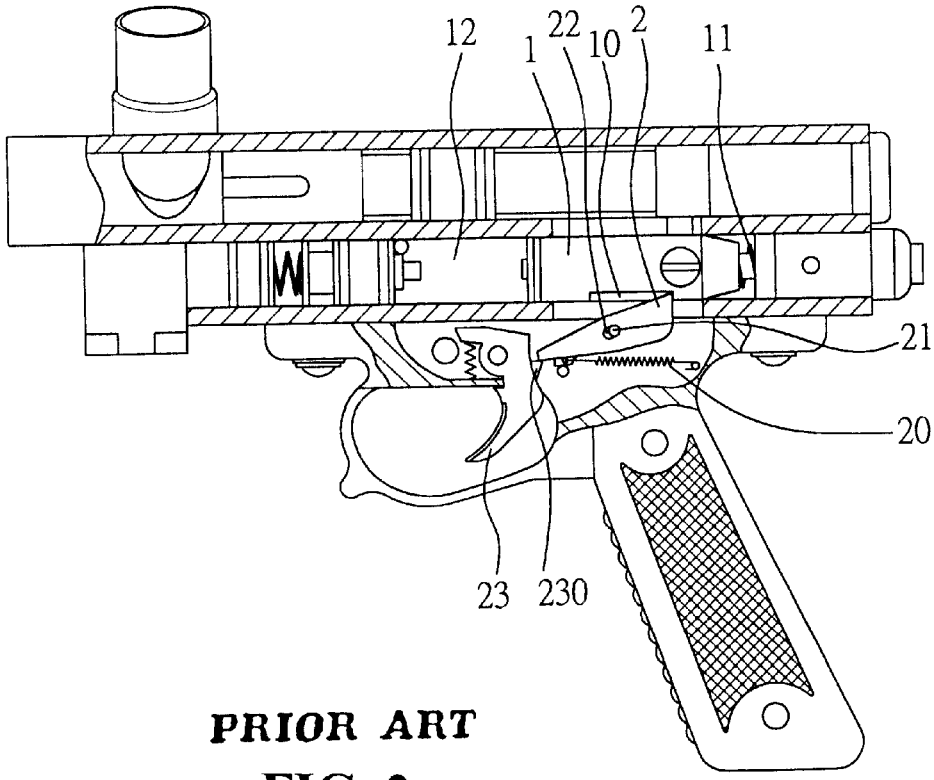
PRIOR ART FIG. 2
FIG. 2 is a sectional view illustrating the prior art paint ball gun which is ready for fire.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 3:
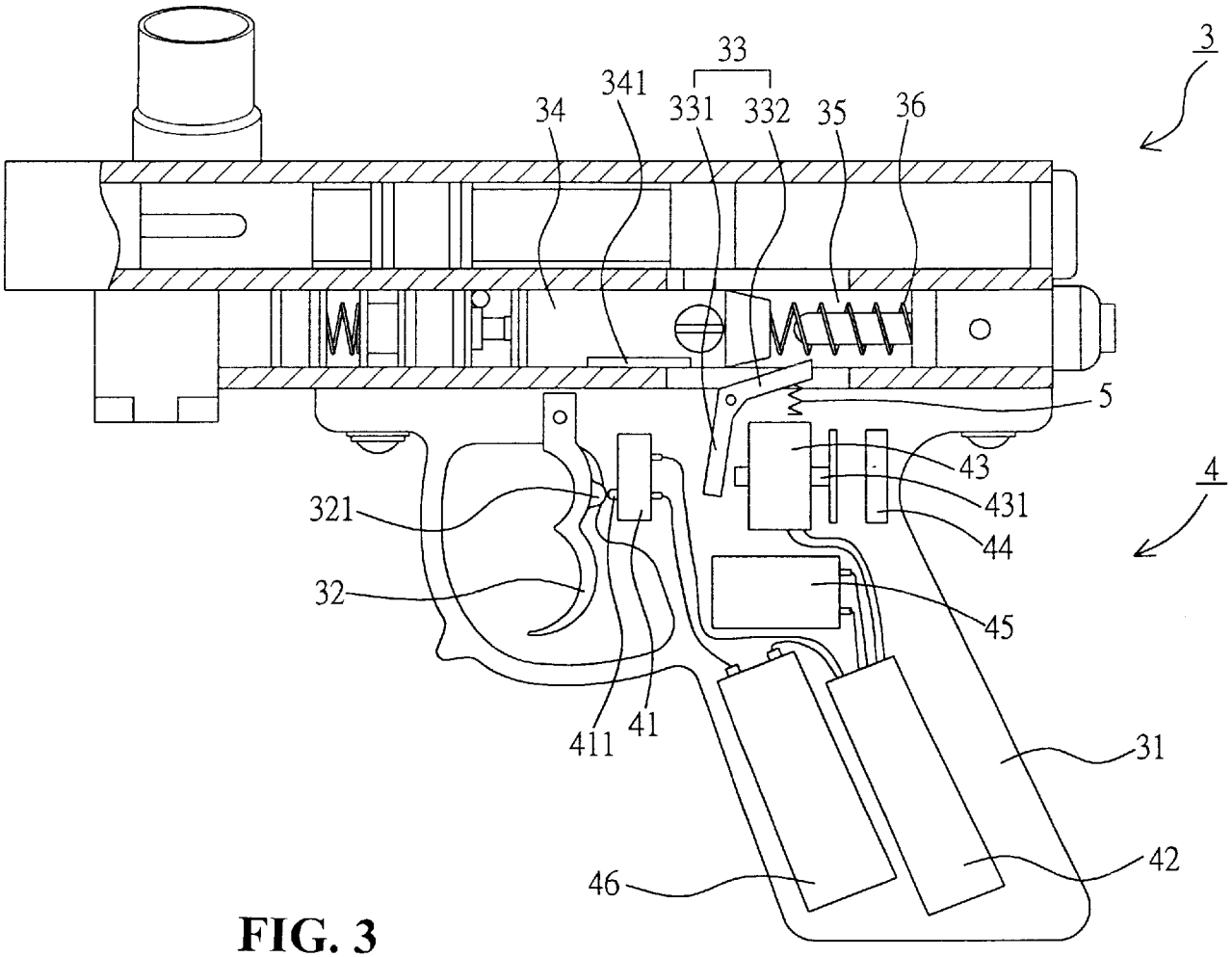
FIG. 3 is a sectional view of the present invention.

With reference to the drawings and in particular to FIG. 3 thereof, the paint ball gun 3 according to the present invention generally comprises a body portion having a handle 31 in which is mounted a solenoid valve assembly 4. The solenoid valve assembly 4 comprises a micro-switch 41, a control circuit board 42, a solenoid valve 43 and a magnet 44.

The micro-switch 41 is mounted behind a trigger 32 and provided with a contact button 411 at the front side thereof so that when the trigger 32 is depressed, the contact button 411 will be depressed too thereby turning on the solenoid valve assembly 4. The trigger 32 is pivotally mounted in the body portion of the paint ball gun 3.

When receiving triggering signal from the micro-switch 41, the control circuit board 42 will drive the valve rod 431 of the solenoid valve 43 to move the lever 33 out of the engagement with the striking rod 34.

The solenoid valve 43 is arranged behind the lever 33 and has a valve rod 431 located opposite to the lower portion 331 of the lever 33.

The magnet 44 is mounted behind the solenoid valve 43 so that the valve rod 431 of the solenoid valve 43 will be attracted to move backward after driving the lower portion 331 of the lever 33.

A spring 5 is installed under the upper portion 332 of the lever 33 for moving the upper portion 332 to its original position after operation. The lever 33 is pivotally mounted within the paint ball gun 3.

The micro-switch 41, the control circuit board 42, the solenoid valve 43, the magnet 44, the capacitor 45 and the battery 46 are electrically connected via conducting wires. As the trigger 32 is depressed, the contact button 411 of the micro-switch 43 will be pressed thereby turning on the micro-switch 41 to cause the control circuit board 42 to operate the solenoid valve 43. Therefore, the valve rod 431 will be driven to push the lower portion 331 of the lever 33 thus moving the upper portion 332 of the lever 33 out of the engagement with the recess 341 of the striking rod 34 (see FIGS. 4 and 5). The striking rod 34 is fitted in the passage 35 of the body portion of the paint ball gun and has an end urged by a spring 36 fitted in the passage 35.

Figure 4:
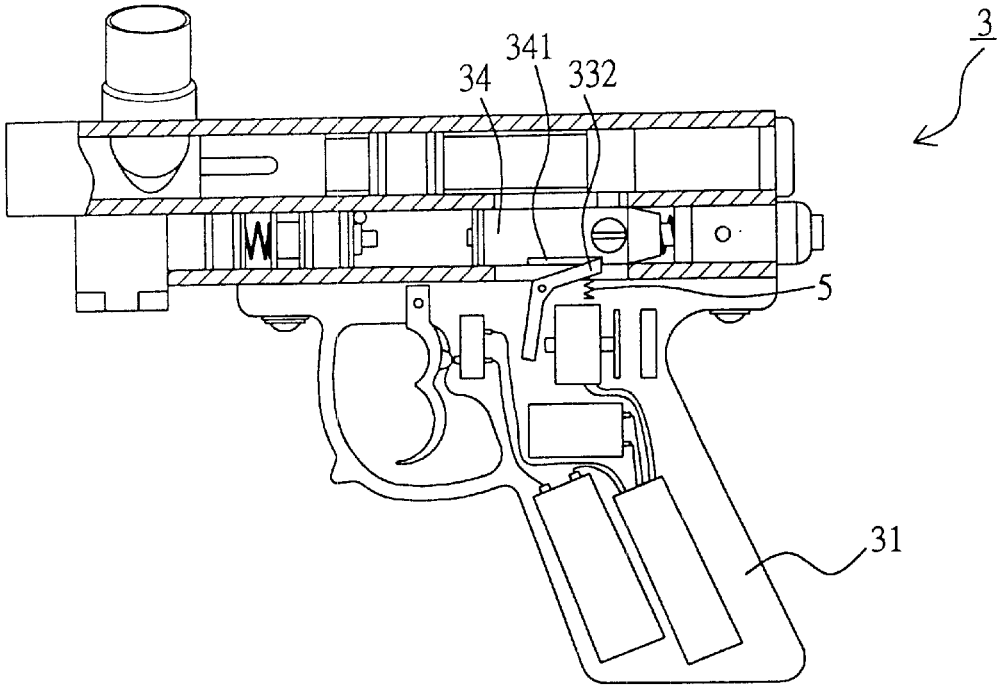
FIG. 4 is a sectional view illustrating the present invention which is ready for fire.

Referring to FIGS. 3 and 4, when the striking rod 34 is moved back, the upper portion 332 of the lever 33 will be depressed thus compressing the spring 5. As the bottom of the striking rod 34 is formed with a recess 341, when the recess 341 of the striking rod 34 is aligned with the upper portion 332 of the lever 32, the spring 5 will push the upper portion 332 of the lever to engage with the recess 341 of the striking rod 34 thereby keeping the striking rod 34 at a fixed position.

Figure 5:
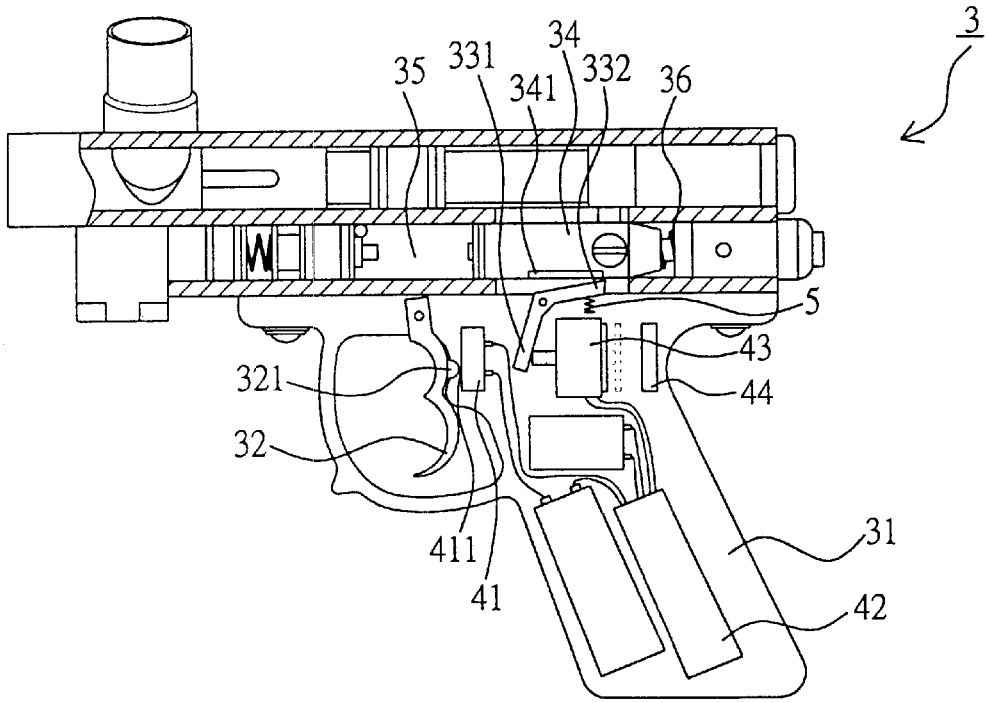
FIG. 5 is a sectional view illustrating the working principle of the present invention.

Looking now at FIG. 5, when the trigger 32 is depressed, the contact button 411 of the micro-switch 43 will be pressed to turn on the micro-switch 41 so as to cause the control circuit board 42 to operate the solenoid valve 43. Then, the valve rod 431 will be driven to push the lower portion 331 of the lever 33 thus moving the upper portion 332 of the lever 33 out of the engagement with the recess 341 of the striking rod 34. Accordingly, the striking rod 34 is released and forced by the spring 36 to go outwardly thus firing a paint bullet out of the paint ball gun 3.

When the striking rod 34 is moved outwardly, the upper portion 332 of the lever 33 will be pushed by the spring 5 into the passage 35 of the paint ball gun 3. In the meantime, the lower portion 331 of the lever 33 will be rotated counterclockwise to push the valve rod 431 back to its original position. The magnet 44 is used for helping and ensuring the valve rod 431 to go back to its original position even if the valve rod 431 is worn down.

Figure 6:
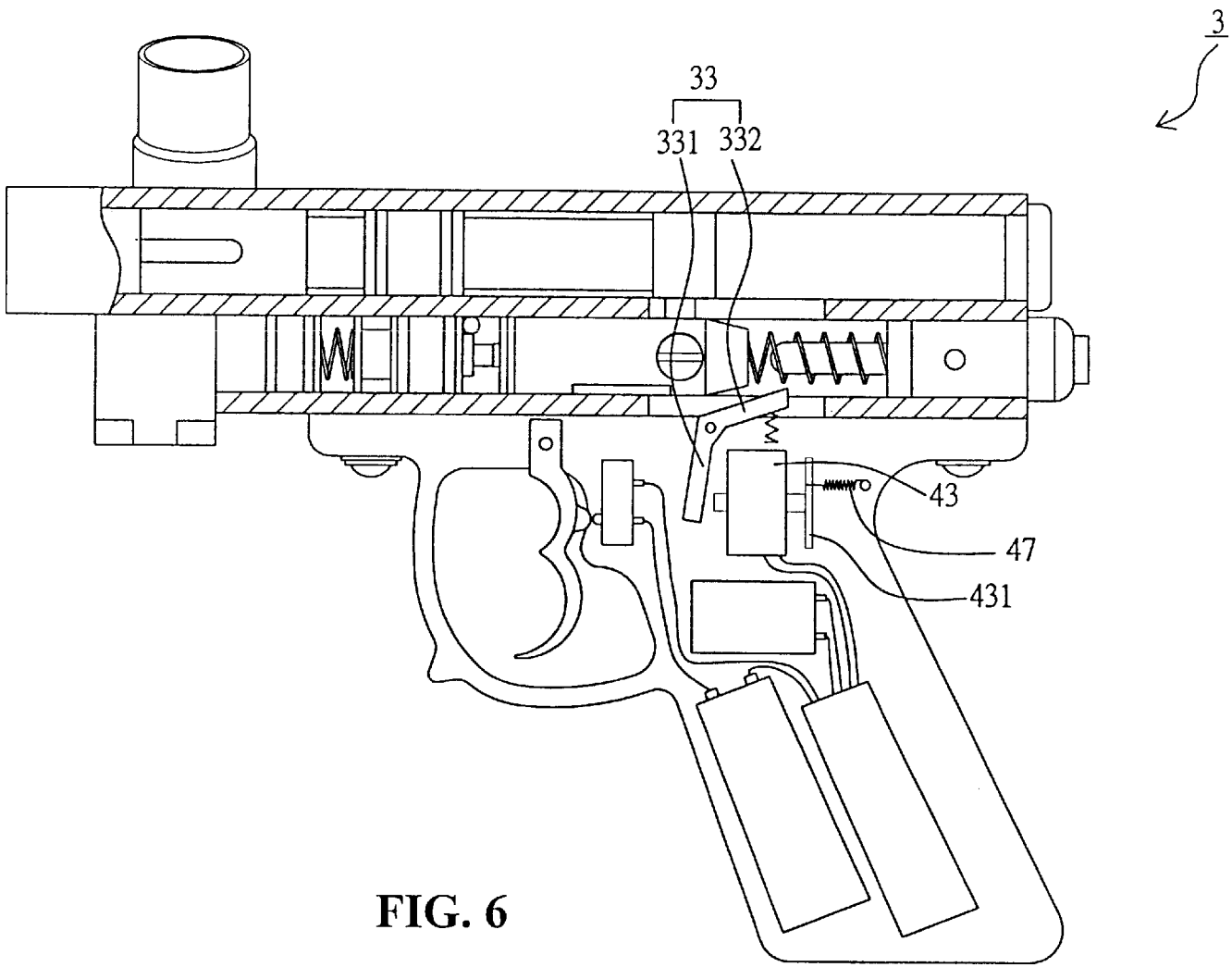
FIG. 6 illustrates another preferred embodiment of the present invention.

FIG. 6 illustrates another preferred embodiment of the present invention. As shown, the magnet is replaced with a spring 47 which has an end connected with the housing of the paint ball gun 3 and another end connected with the valve rod 431, so that the spring 43 will pull the valve rod 431 to return to its original position after operation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a paint ball gun comprising a body portion having a handle, and a triggering mechanism mounted within said body portion and said handle, improvement wherein said triggering mechanism comprises a trigger pivotally mounted in said body portion, a micro-switch mounted within said handle and having a contact button disposed behind said trigger, a solenoid valve having a valve rod, means for controlling said valve rod of said solenoid valve by way of said micro-switch, a magnet mounted within said handle for attracting said valve rod to original position, a lever having a lower portion aligned with said valve rod and an upper end extending into a passage of said body portion, a first spring urging said upper end of said lever into said passage, a striking rod slidably fitted in said passage and having a bottom formed with a recess, and a second spring fitted in said passage and having an end urging against an end of said striking rod.

* * * * *